US006205967B1

(12) United States Patent
Alvine

(10) Patent No.: US 6,205,967 B1
(45) Date of Patent: Mar. 27, 2001

(54) AUTOMATIC ENGINE BLOCK HEATER CONNECTION APPARATUS

(76) Inventor: Frank G. Alvine, 1500 W. 22nd St., Sioux Falls, SD (US) 57105

( * ) Notice: Subject to any disclaimer, the term of this patent is extended or adjusted under 35 U.S.C. 154(b) by 0 days.

(21) Appl. No.: 09/498,186

(22) Filed: Feb. 4, 2000

(51) Int. Cl.[7] ..... F02N 17/02
(52) U.S. Cl. ..... 123/142.5 E
(58) Field of Search ..... 123/142.5 E

(56) References Cited

U.S. PATENT DOCUMENTS

| | | | |
|---|---|---|---|
| 3,194,944 | 7/1965 | Papp . | |
| 3,628,811 | 12/1971 | Rivers . | |
| 4,850,879 | 7/1989 | Langenbahn . | |
| 5,252,078 | 10/1993 | Langenbahn . | |
| 5,462,439 | 10/1995 | Keith . | |
| 5,572,109 | 11/1996 | Keith . | |
| 5,646,500 | 7/1997 | Wilson . | |
| 5,919,048 * | 7/1999 | Slattery | 439/34 |

* cited by examiner

*Primary Examiner*—Noah P. Kamen

(74) *Attorney, Agent, or Firm*—Merchant & Gould P.C.

(57) ABSTRACT

An apparatus having an automobile engine block heater installed on a vehicle where the automobile engine block heater is automatically activated when the vehicle is properly positioned within a frame assembly. The apparatus includes at least two magnetic electrical adapters, one of which is mounted to the front of the vehicle and the other is mounted to the frame assembly. In one embodiment, the frame assembly includes an upright portion and a lower portion that lies flat on the floor. The upright portion secures the second magnetic electrical adapter that mates to the adapter on the front of the car. The upright portion is adjustable to match the height of the front of the car. Similarly, the lower portion includes a wheel well that receives a front vehicle wheel and is adjustable to match the length of the front end of the vehicle. The wheel well stops the vehicle when it is positioned properly, permitting the magnetic electrical adapters to mate. In a preferred embodiment, the apparatus also includes a status indicator designed to energize when the vehicle is properly positioned relative to the frame assembly. The upper portion is pivotably mounted to the lower portion to provide lateral range of motion in case the car overruns the wheel well. Conversely, a stop is used to disengage the magnetic electrical adapters when the car is backed away from the frame assembly.

11 Claims, 1 Drawing Sheet

AUTOMATIC ENGINE BLOCK HEATER CONNECTION APPARATUS

FIELD OF THE INVENTION

This invention relates generally to automobile engine block heaters, and more particularly, to an automobile engine block heater designed to automatically activate.

BACKGROUND OF THE INVENTION

Starting an automobile in cold climates has always been a challenge. Cold weather stifles the operation of several key components of an automobile's starting system, including the battery, starter motor, and the engine itself. To minimize the effects of cold weather, automobile engine block heaters have long been used. Automobile engine block heaters typically make starting the car in cold weather easier and prevent damage to the engine due to poor lubrication from cold and poor flowing oil at the time of the cold start. Furthermore, automobile engine block heaters typically reduce the time it takes for the engine to reach its optimum operating temperature. While many existing automobile engine block heaters adequately address these concerns, several key shortcomings make many existing automobile engine block heaters counterproductive to the user's overall needs for a fast and reliable method of activating the automobile engine block heater once the driver has reached his or her destination.

Typical automobile engine block heaters require the driver to exit the car and manually connect the engine block heater to a power source. Oftentimes, drivers will forego connecting the engine block heater to the power source as they hastily seek the warmth and shelter of their homes. Other drivers might simply forget to connect the engine block heater to the power source. In either case, the automobile engine block heater is not activated and thus cannot provide the aforementioned benefits.

Moreover, the power cord from many existing engine block heaters typically dangles from the front of the car and thus becomes exposed to water, snow and other substances during normal operation of the vehicle. This can result in corrosion or damage to the power cord leads or damage to the cord itself. Hence, the driver may be confronted with a significant risk of electrical shock as he or she attempts to connect the engine block heater to a power source.

No apparatus currently exists that automatically activates an automobile engine block heater once the vehicle has reached its parking destination. Because of the manual activation required on existing engine block heaters and the possibility for injury to the driver, an automobile engine block heater system is needed wherein the engine block heater is automatically activated when the vehicle reaches its destination.

SUMMARY OF THE INVENTION

The present invention is directed to an apparatus for automatically activating an automobile engine block heater once the vehicle is properly positioned against a stationary frame assembly. The apparatus includes a stationary frame assembly and at least two magnetic electrical adapters or other mating adapters. The stationary frame assembly includes an upright portion and a lower portion. The lower portion rests flat on the floor or ground and is pivotably mounted at or near its proximal end to the upright portion. The upright portion extends vertically upwards from the floor or ground. Furthermore, the upright portion secures a first adapter at or near its distal end. In one embodiment, the first adapter couples with a second adapter securably mounted on the front of the vehicle.

Moreover, the lower portion of the frame assembly also includes a wheel well for receiving a front wheel of the vehicle. The wheel well is attached at or near the distal end of the lower portion and serves to inhibit the forward and rearward motion of the vehicle and aids the driver in aligning the vehicle. Once the vehicle is properly positioned relative to the frame assembly, the magnetic electrical adapter located on the front of the vehicle mates with the magnetic electrical adapter mounted on the frame assembly.

Use of the apparatus requires the driver to position the vehicle relative to the frame assembly such that the magnetic electrical adapter on the front of the vehicle mates with the magnetic electrical adapter secured on the frame assembly. To accomplish this, the driver aligns the vehicle with the frame assembly. In one embodiment, as the driver approaches the apparatus, he or she guides one of the front wheels of the vehicle into the wheel well attached to the frame assembly. The driver then slowly advances the vehicle such that the front wheel rests within the depression of the wheel well. When the vehicle wheel is properly seated within the wheel well, the vehicle wheel closes a pressure switch located within the depression of the wheel well. This switch activates a status indicator that alerts the user that the vehicle is properly positioned relative to the frame assembly and that the automobile engine block heater is active.

The present invention allows a driver of a vehicle to automatically activate an automobile engine block heater with minimal effort. The driver of the vehicle can easily align the vehicle with the apparatus and position the vehicle relative to the frame assembly. Once the vehicle is positioned properly, the automobile engine block heater engages and the driver can exit the car without any other considerations.

The above summary of the present invention is not intended to describe each illustrated embodiment or every implementation of the present invention. Other objects, features and advantages of the present invention will become more apparent in light of the following detailed description of exemplary embodiments thereof, as illustrated in the accompanying drawings.

BRIEF DESCRIPTION OF THE DRAWINGS

The invention may be more completely understood in consideration of the following detailed description of various embodiments of the invention in connection with the accompanying drawings, in which.

Figure 1:
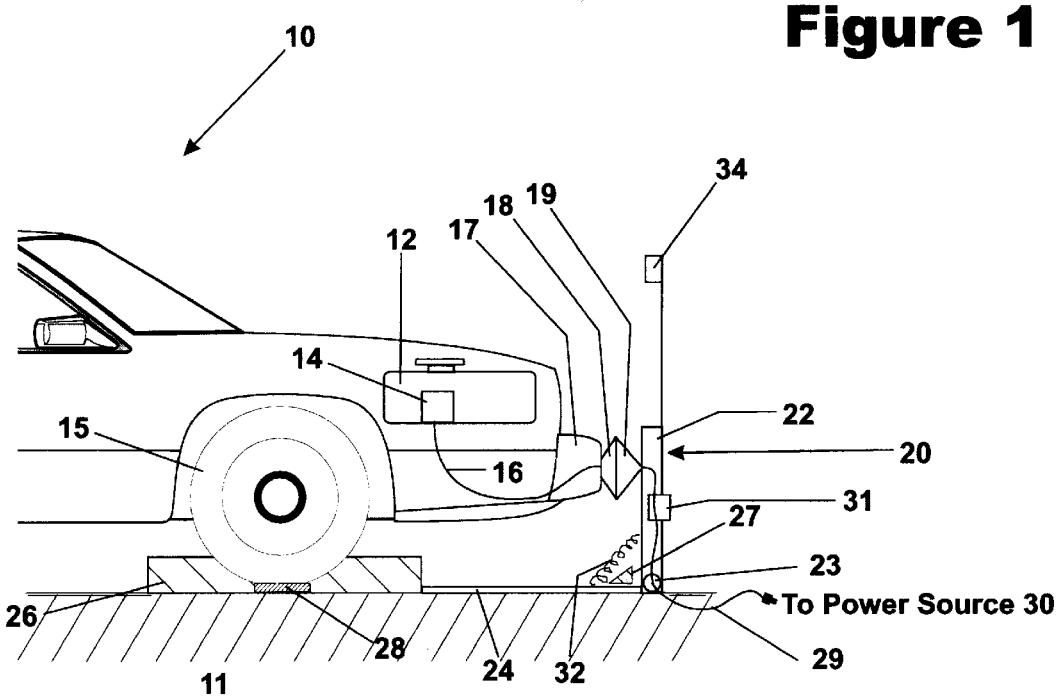
FIG. 1 shows a side elevational view of an apparatus according to the principles of the present invention with a vehicle properly positioned relative to a frame assembly and the automobile engine block heater is activated.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE PREFERRED EMBODIMENT

The present invention is generally directed towards automobile engine block heaters and in particular is directed towards an automobile engine block heater designed to automatically activate when the vehicle is properly positioned relative to a frame assembly. While the present invention is not so limited, a more detailed understanding of the present invention will be gained through a discussion of the drawings in connection with the examples provided below.

FIG. 1 shows a side view of a vehicle 10 positioned relative to a frame assembly 20. In one embodiment of the present invention, frame assembly 20 is located at the driver's primary destination, such as at the driver's home in a garage. Moreover, in an alternative embodiment of the present invention, a driver can have two or more frame assemblies 20 at two or more locations that are compatible with engine block heater 14 installed on vehicle 10. For example, a driver can have a frame assembly 20 located at home and at a parking space at work.

Frame assembly 20 is secured to the garage floor 11 and includes a lower portion 24 and an upright portion 22. In one embodiment of the present invention, frame assembly 20 can be secured to floor 11 in a conventional manner, for example with screws or other fastening devices. Alternatively, frame assembly 20 can be secured to floor 11 using the weight of the vehicle. Upright portion 22 is pivotally attached to the proximal end of lower portion 24 at pivot 23 and is biased in its upright position by means of spring 32. The upright portion 22 extends vertically upwards and substantially perpendicular to the floor 11. A first magnetic electrical adapter 19 is secured to the distal end of upright portion 22 and is connected to a power source 30 via power cord 29. In one embodiment of the present invention, power source 30 is a standard household power supply, such as 110 volts, which is the typical voltage required for engine block heaters.

Lower portion 24 of the frame assembly 20 rests flatly on the floor 11. In one embodiment, a wheel well 26 is attached to or near the distal end of lower portion 24. Wheel well 26 serves to inhibit the forward and rearward motion of the vehicle 10 and aids the driver in aligning the vehicle 10. Wheel well 26 receives a front vehicle wheel 15 and is used to properly position the vehicle 10 within the frame assembly 20. Once vehicle wheel 15 is properly positioned within wheel well 26, the weight of vehicle 10 acting through wheel 15 closes pressure switch 28. In one embodiment of the present invention, when pressure switch 28 is closed, status indicator 34 is energized. Status indicator 34 is electrically coupled to pressure switch 28 and can be a light bulb, LED, or other similar indicating device. Status indicator 34 is attached to the distal end of upright portion 22 and preferably extends to a height sufficient to allow the driver to readily determine its current state. Alternatively, status indicator 34 can be mounted on a wall within the driver's field of vision once the vehicle 10 is positioned within the frame assembly 20. Furthermore, status indicator 34 is mounted at a location to assist the driver when aligning the vehicle 10 relative to the frame assembly 20.

FIG. 1 also shows an engine block heater 14 fixedly attached to the vehicle's engine 12. Such block heaters 14 are well known and typically available on automobiles as an original equipment option. The engine block heater power cord 16 runs from the engine block heater 14 towards the front of the vehicle where it is connected to a second magnetic electrical adapter 18. Magnetic electrical adapter 18 is securely attached to the front of the vehicle 10. In one embodiment of the present invention, the magnetic electrical adapter 18 is securely attached to front bumper 17. Moreover, automobile engine block heater 14 is electrically wired directly to magnetic electrical adapter 18. In another embodiment, the magnetic electrical adapter 18 can be modified to receive a power cord from a conventional engine block heater.

Once vehicle 10 is properly positioned against wheel well 26 as described above, magnetic electrical adapter 18 mates with the magnetic electrical adapter 19 mounted on the upright portion 22 of the frame assembly 20. When the magnetic electrical adapters 18 and 19 have mated, the automobile engine block heater 14 is activated. In one embodiment of the present invention, the mating of the adapters 18 and 19 also energizes the status indicator 34. For example, closing of pressure switch 28 energizes a first signal on status indicator 34, and mating of adapters 18 and 19 energizes a second signal on status indicator 34.

To ensure proper mating of the magnetic electrical adapters, both upright portion 22 and lower portion 24 of the frame assembly 20 are adjustable. For example, upright portion 22 can be adjusted vertically. This allows the height of magnetic electrical adapter 19 to correspond with the height of magnetic electrical adapter 18 mounted on the front of the vehicle. Furthermore, lower portion 24 can be adjusted in a direction parallel to the motion or length of the vehicle. This allows the length of the frame assembly 20 to correspond with the length of the front end of the vehicle. In one embodiment of the present invention, frame assembly 20 is adjusted properly when the vehicle 10 is properly positioned within frame assembly 20, magnetic electrical adapters 18 and 19 have mated, and upright portion 22 extends substantially perpendicular to floor 11.

Additionally, in a preferred embodiment of the present invention, it may be necessary to include a power converter to convert the alternating current of power source 30 to a direct current source. To accomplish this, an AC-DC converter 31 can be electrically coupled between magnetic electrical adapter 19 and power source 30. For example, in a preferred embodiment of the present invention, AC-DC converter 31 is a rectifier and is directly mounted to upright portion 22. In so doing, a direct current passes through magnetic electrical adapters 18 and 19 that is suitable for connection to engine block heater 14.

Additional features of the present invention prevent damage from occurring to either the vehicle 10 or the apparatus 20 and aid in alignment and engagement. Wheel well 26 limits the forward and rearward motion of the vehicle once the wheel well receives a front vehicle wheel 15. For example, once vehicle wheel 15 engages wheel well 26, the driver knows to slow the forward motion of the vehicle to prevent the vehicle 10 from overrunning the wheel well. Moreover, as described above, upright portion 22 is pivotally mounted to lower portion 24 allowing upright portion 22 lateral range of motion in a direction parallel to the motion of the vehicle. Thus, even if the vehicle were to overrun wheel well 26, upright portion 22 will rotate about pivot point 23. In so doing, no damage would occur either to vehicle 10 or to frame assembly 20.

Use of the apparatus requires the driver to position the vehicle 10 relative to the frame assembly 20 such that the magnetic electrical adapter 18 mounted on the front of the vehicle 10 mates with the magnetic electrical adapter 19 on the frame assembly. Before using the apparatus for the first time, the user must first select a desirable location for the frame assembly 20. In one embodiment of the invention, the frame assembly 20 is located at the driver's primary destination, for example, within the driver's garage. Frame assembly 20 can be mounted either close to a wall or some other point of reference to allow the driver to easily align the vehicle within the frame assembly 20.

Figure 2:
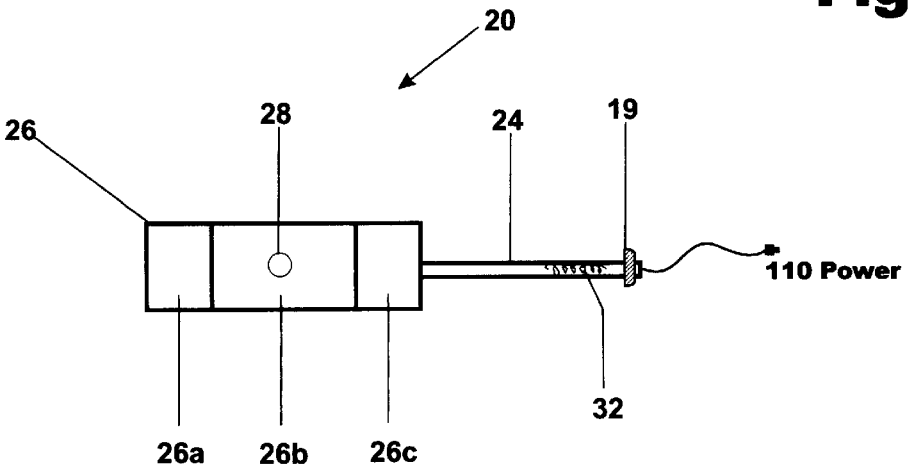
FIG. 2 shows a top view of the apparatus shown in FIG. 1 further illustrating the components of the frame assembly.

Referring to FIG. 2, as the vehicle begins to engage wheel well 26 at front edge 26*a*, the driver knows to begin to slow the forward motion of the vehicle. When the vehicle overcomes front edge 26*a* and vehicle wheel 15 enters depression 26*b*, the forward motion of the vehicle 10 is further slowed as the vehicle wheel 15 encounters rear edge 26*c* of the wheel well. After the forward and rearward motion of the vehicle 10 has stopped, the vehicle is properly positioned relative to the frame assembly 20 so that the electrical adapters 18 and 19 engage, and the automobile engine block heater 14 is activated.

As described above, in case the vehicle 10 overruns rear edge 26*c* of the wheel well, the upper portion 22 of the frame assembly 20 is pivotally mounted at 23 to provide for lateral range of motion in the direction of the vehicle movement. This prevents damage to the vehicle 10 or to the frame assembly 20. After the vehicle 10 is moved rearward to a position either in front of or within wheel well 26, spring 32 returns upper portion 22 to its upright position substantially perpendicular to the floor.

As described above, when the vehicle 10 is properly positioned relative to the frame assembly, status indicator 34 is energized and informs the driver that the automobile engine block heater 14 is activated. Moreover, status indicator 34 can provide different states that can be used notify the driver when vehicle wheel 15 has engaged the front edge 26*a* of the wheel well or when the vehicle has overrun the wheel well.

Moreover, to disengage the apparatus, the driver must move the vehicle 10 in a rearward direction out of wheel well 26. Stop 27 is provided on lower portion 24 of the frame assembly to prevent upright portion 22 from pivoting beyond pivot point 23 as the vehicle 10 exits the frame assembly 20. In so doing, magnetic electrical adapter 19 mounted on upper portion 22 disengages from magnetic electrical adapter 18 mounted on the front of the vehicle 10.

In a preferred embodiment of the invention, magnetic electrical adapter 19 is de-energized when the vehicle is not properly positioned in the frame assembly 20. This prevents accidental electrical shock to a child or other person who may come into contact with magnetic electrical adapter 19 while the apparatus is not in use.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. An apparatus for automatically activating an automobile engine block heater, comprising:

a first magnetic electrical adapter;

a second magnetic electrical adapter; and a frame assembly comprising an upright member pivotally connected to a lower member, for receiving an automobile, wherein the first magnetic electrical adapter is mounted to a distal end of the upright member of the frame assembly and is electrically coupled to a power source and the second magnetic electrical adapter is mounted to the automobile and is electrically coupled to the engine block heater;

whereby the automobile engine block heater is automatically activated when the automobile is positioned relative to the frame assembly allowing the first and second electrical adapters to mate.

2. The apparatus of claim 1, wherein a wheel well is attached to the distal end of the lower member, the wheel well being sized and configured to receive an automobile wheel when the automobile is positioned relative to the frame assembly allowing the first and second electrical adapters to mate and further assisting the user when positioning the automobile relative to the frame assembly.

3. The apparatus of claim 2, further comprising a status indicator, wherein the status indicator is energized by a pressure switch located in the wheel well attached to the distal end of the lower member.

4. The apparatus of claim 1, further comprising a status indicator, wherein the status indicator is energized when the automobile is positioned relative to the frame assembly allowing the first and second electrical adapters to mate.

5. The apparatus of claim 1, wherein the first magnetic electrical adapter is electrically coupled to a rectifier for converting an alternating power source to a direct current power source for providing power to the engine block heater.

6. A method for automatically activating an automobile engine block heater mounted on an automobile, comprising the steps of:

(a) providing a first magnetic electrical adapter, a second magnetic electrical adapter, and a frame assembly comprising an upright member pivotally connected to a lower member, wherein the first magnetic electrical adapter is mounted on the automobile in electrical connection to the engine block heater and the second magnetic electrical adapter is mounted on a distal end of the upright member of the frame assembly and connected to an electrical power source;

(b) aligning the first magnetic electrical adapter mounted on the front of the automobile with the second magnetic electrical adapter mounted on the frame assembly; and (c) receiving an automobile relative to the frame assembly such that the first magnetic electrical adapter engages the second magnetic electrical adapter, thereby automatically energizing the engine block heater.

7. The method of claim 8, wherein aligning the first magnetic electrical adapter with the second magnetic electrical adapter comprises the further step of attaching a wheel well to the distal end of the lower member, wherein the wheel well is sized and configured to receive an automobile wheel when the automobile is positioned relative to the frame assembly allowing the first and second electrical adapters to mate.

8. The method of claim 6, wherein the method further comprises the step of indicating when the automobile is positioned relative to the frame assembly to engage the first and second electrical adapters.

9. The method of claim 8, wherein indicating when the automobile is positioned relative to the frame assembly comprises energizing a status indicator when the automobile is positioned relative to the frame assembly allowing the first and second electrical adapters to mate.

10. A method for automatically activating an automobile engine block heater mounted on an automobile, comprising the steps of:

(a) providing a first magnetic electrical adapter, a second magnetic electrical adapter, and a frame assembly, wherein the first magnetic electrical adapter is mounted on the automobile in electrical connection to the engine block heater and the second magnetic electrical adapter is mounted on the frame assembly and connected to an electrical power source;

(b) aligning the first magnetic electrical adapter mounted on the front of the automobile with the second magnetic electrical adapter mounted on the frame assembly; and receiving an automobile relative to the frame assembly such that the first magnetic electrical adapter engages the second magnetic electrical adapter, thereby automatically energizing the engine block heater;

indicating when the automobile is positioned relative to the frame assembly to engage the first and second electrical adapters by energizing a status indicator allowing the first and second electrical adapters to mate, wherein the status indicator is energized by a pressure switch located in a wheel well attached to the distal end of the lower member, the wheel well being sized and configured to receive an automobile wheel when the automobile is positioned relative to the frame assembly to engage the first and second electrical adapters.

11. An apparatus for automatically activating an automobile engine block heater, comprising:

a first magnetic electrical adapter;

a second magnetic electrical adapter; and a frame assembly for receiving an automobile, wherein the first magnetic electrical adapter is mounted to the frame assembly and is electrically coupled to a power source and the second magnetic electrical adapter is mounted on the automobile's bumper and is electrically coupled to the engine block heater;

whereby the automobile engine block heater is automatically activated when the automobile is positioned relative to the frame assembly allowing the first and second electrical adapters to mate.

* * * * *